US012053683B2

(12) United States Patent
Howze

(10) Patent No.: US 12,053,683 B2
(45) Date of Patent: Aug. 6, 2024

(54) FENCING TARGET ASSEMBLY

(71) Applicant: Joseph Howze, Chula Vista, CA (US)

(72) Inventor: Joseph Howze, Chula Vista, CA (US)

( * ) Notice: Subject to any disclaimer, the term of this patent is extended or adjusted under 35 U.S.C. 154(b) by 271 days.

(21) Appl. No.: 17/688,551

(22) Filed: Mar. 7, 2022

(65) Prior Publication Data

US 2023/0277907 A1 Sep. 7, 2023

(51) Int. Cl.
*A63B 69/02* (2006.01)

(52) U.S. Cl.
CPC ..... *A63B 69/02* (2013.01); *A63B 2225/09* (2013.01)

(58) Field of Classification Search
CPC ..... A63B 69/02; A63B 69/22; A63B 69/215
See application file for complete search history.

(56) References Cited

U.S. PATENT DOCUMENTS 3,576,323 A 4/1971 Peltier
4,662,630 A * 5/1987 Dignard ..... A63B 69/331 482/83
4,749,184 A * 6/1988 Tobin ..... A63B 69/0091 482/129
5,277,679 A * 1/1994 Wells ..... A63B 69/22 482/90
D377,201 S 1/1997 Howard
5,967,523 A * 10/1999 Brownlee ..... F41J 1/10 273/407
7,293,777 B2 11/2007 Lewis
7,922,628 B2 4/2011 Gonzalez
7,981,009 B2 * 7/2011 Brenner ..... A63B 69/22 482/90
9,915,507 B1 * 3/2018 Cummins ..... F41J 1/10
9,925,447 B2 * 3/2018 Hajnasr ..... A63B 69/28
10,926,149 B2 2/2021 Scott
2008/0076636 A1 * 3/2008 Smith ..... A63B 69/322 482/1
2009/0264262 A1 * 10/2009 Brenner ..... A63B 69/22 482/83
2011/0275492 A1 * 11/2011 Brenner ..... A63B 69/22 482/83
2013/0059699 A1 * 3/2013 Brenner ..... A63B 69/224 482/83
2014/0155228 A1 * 6/2014 Salerno ..... A63B 71/023 482/84
2014/0213418 A1 * 7/2014 Lewicki ..... A63B 69/02 482/12

(Continued)

FOREIGN PATENT DOCUMENTS

DE 10010645 A1 * 9/2001 ..... A63B 69/20
WO WO2020055868 3/2020

*Primary Examiner* — Joshua T Kennedy

(57) ABSTRACT

A fencing target assembly for practicing fencing includes a stand that has a plurality of hinged members. The stand is positionable in a deployed position having each of the hinged members defining a respective leg of a triangle such that the stand can be vertically oriented on a support surface. The stand has a track that is integrated into a respective one of the hinged members. A plurality of targets is each attachable to the stand having each of the targets placed at a variety of locations on the stand. In this way each of the targets can facilitate a user to practice fencing maneuvers. Each of the targets has a penetrable element to facilitate a fencing foil to penetrate the penetrable element.

13 Claims, 6 Drawing Sheets

(56) References Cited

U.S. PATENT DOCUMENTS

| | | | | |
|---|---|---|---|---|
| 2015/0179084 | A1* | 6/2015 | Cooper | A63B 69/22<br>434/250 |
| 2021/0291030 | A1* | 9/2021 | Anousis | F41B 13/02 |
| 2022/0323844 | A1* | 10/2022 | Pallesen, III | A63B 69/02 |
| 2023/0173368 | A1* | 6/2023 | Allen | A63B 71/023<br>473/459 |
| 2024/0009541 | A1* | 1/2024 | Hadaway | A63B 23/0211 |

* cited by examiner

FENCING TARGET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fencing devices and more particularly pertains to a new fencing device for practicing fencing. The device includes a stand comprising a plurality of hinged members that can be oriented to form a triangle. A track is integrated into the stand and a plurality of targets is provided that can engage the track. Each of the targets includes a penetrable element that can be pierced by a fencing foil without damaging the fencing foil. In this way the targets facilitate a user to practice fencing maneuvers.

(2) Description of Related Art Including Information Disclosed under 37 CFR 1.97 and 1.98

The prior art relates to fencing devices including a fencing target that includes a panel pivotally mounted between a pair of stanchions and a cushion mounted to panel for piercing with a fencing foil. The prior art discloses a variety of striking practice devices that includes a frame having a plurality of arms and a plurality of pads each disposed on a respective arm for practicing striking.

BRIEF SUMMARY OF THE INVENTION

An embodiment of the disclosure meets the needs presented above by generally comprising a stand that has a plurality of hinged members. The stand is positionable in a deployed position having each of the hinged members defining a respective leg of a triangle such that the stand can be vertically oriented on a support surface. The stand has a track that is integrated into a respective one of the hinged members. A plurality of targets is each attachable to the stand having each of the targets placed at a variety of locations on the stand. In this way each of the targets can facilitate a user to practice fencing maneuvers. Each of the targets has a penetrable element to facilitate a fencing foil to penetrate the penetrable element.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
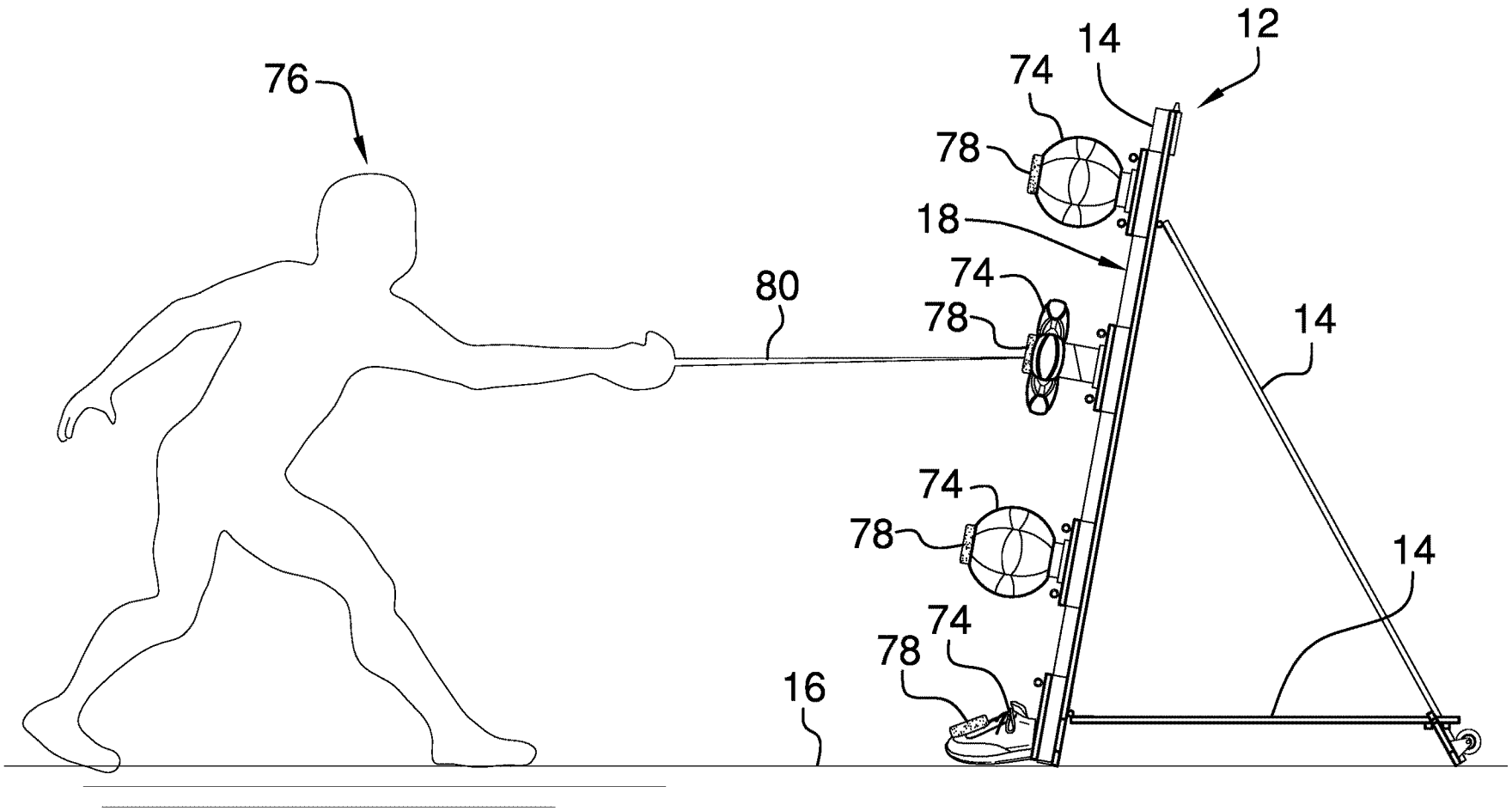
FIG. 1 is a perspective in-use view of a fencing target assembly according to an embodiment of the disclosure.
Figure 2:
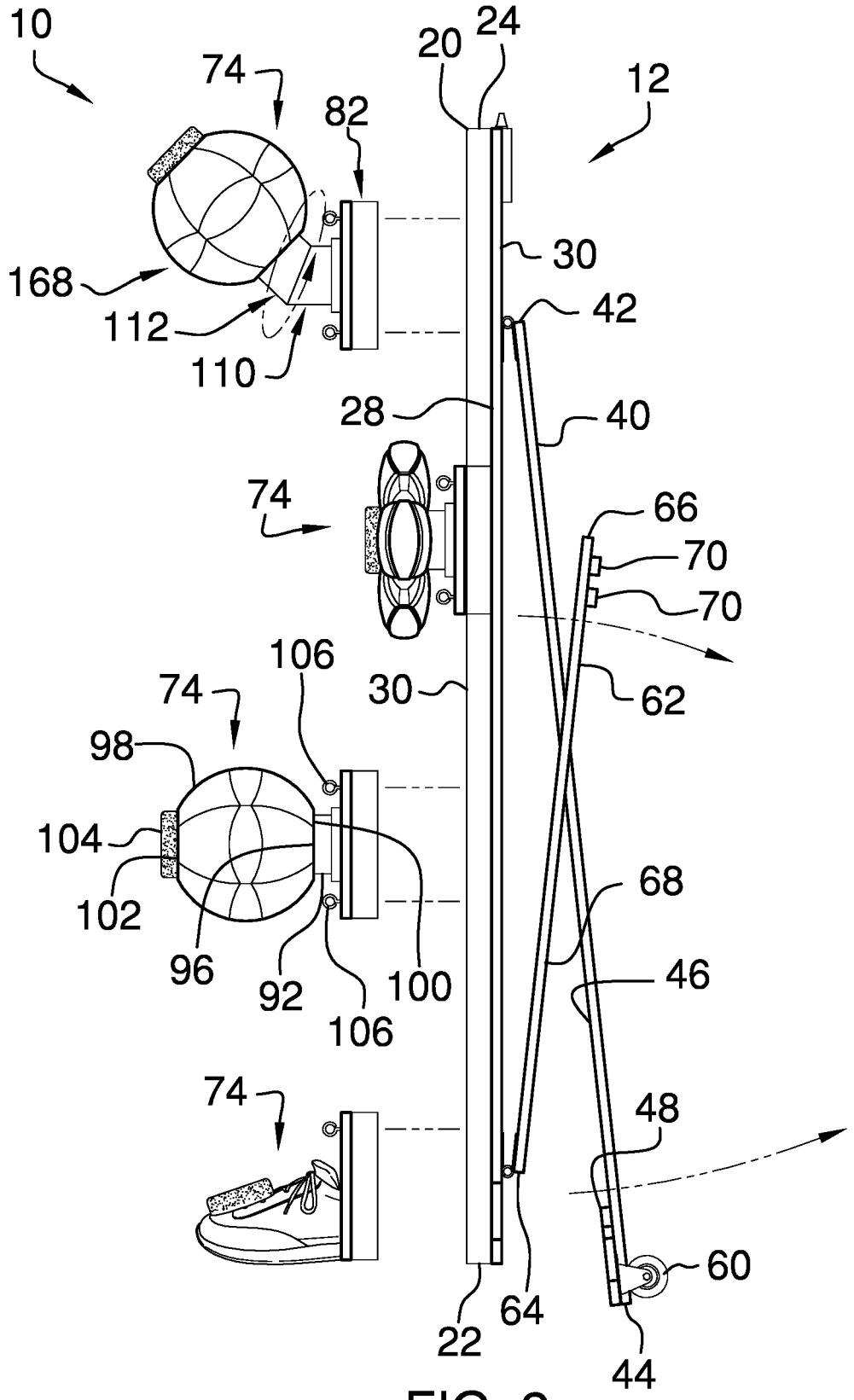
FIG. 2 is a left side view of an embodiment of the disclosure.
Figure 3:
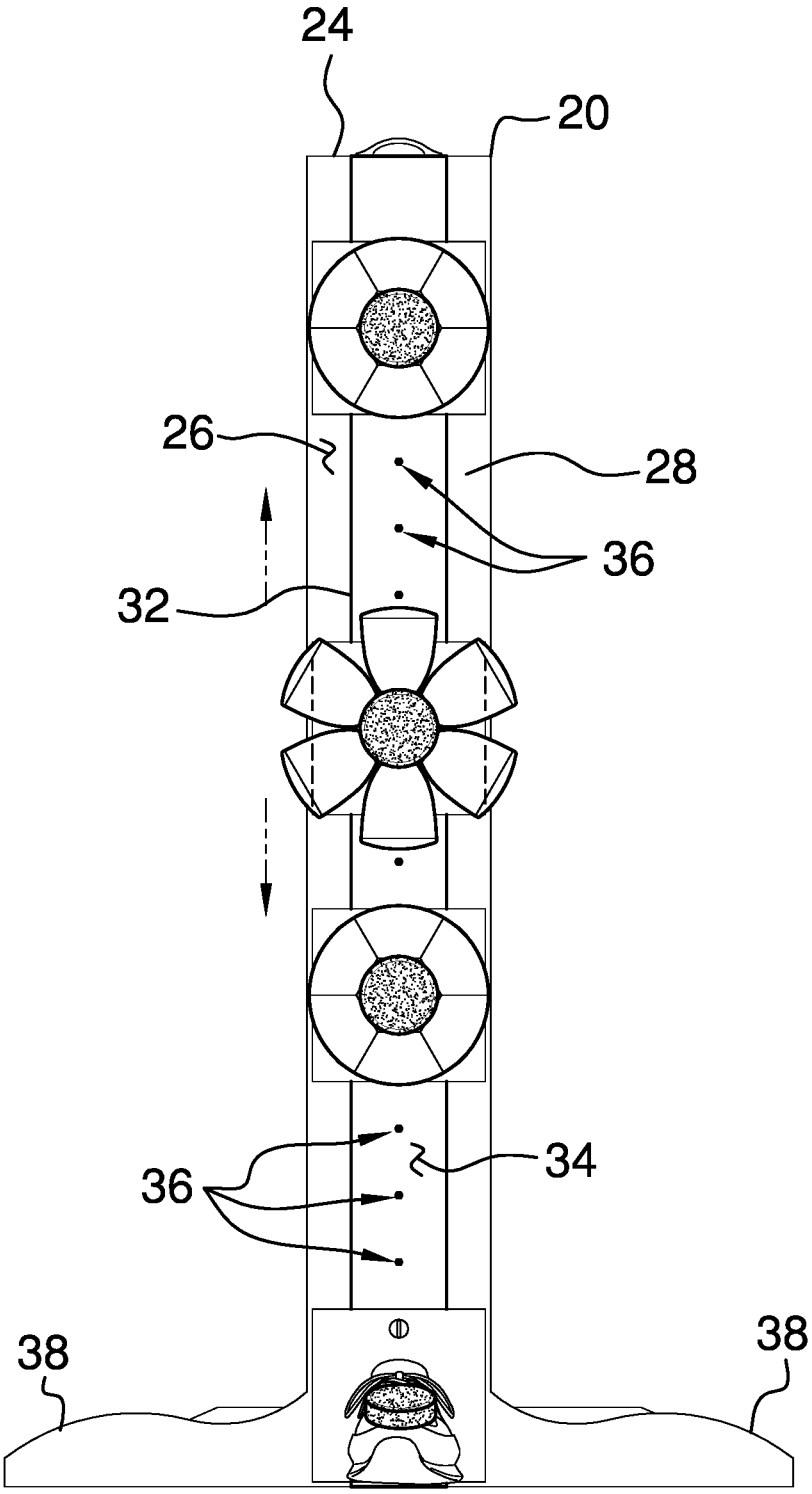
FIG. 3 is a front view of an embodiment of the disclosure.
Figure 4:
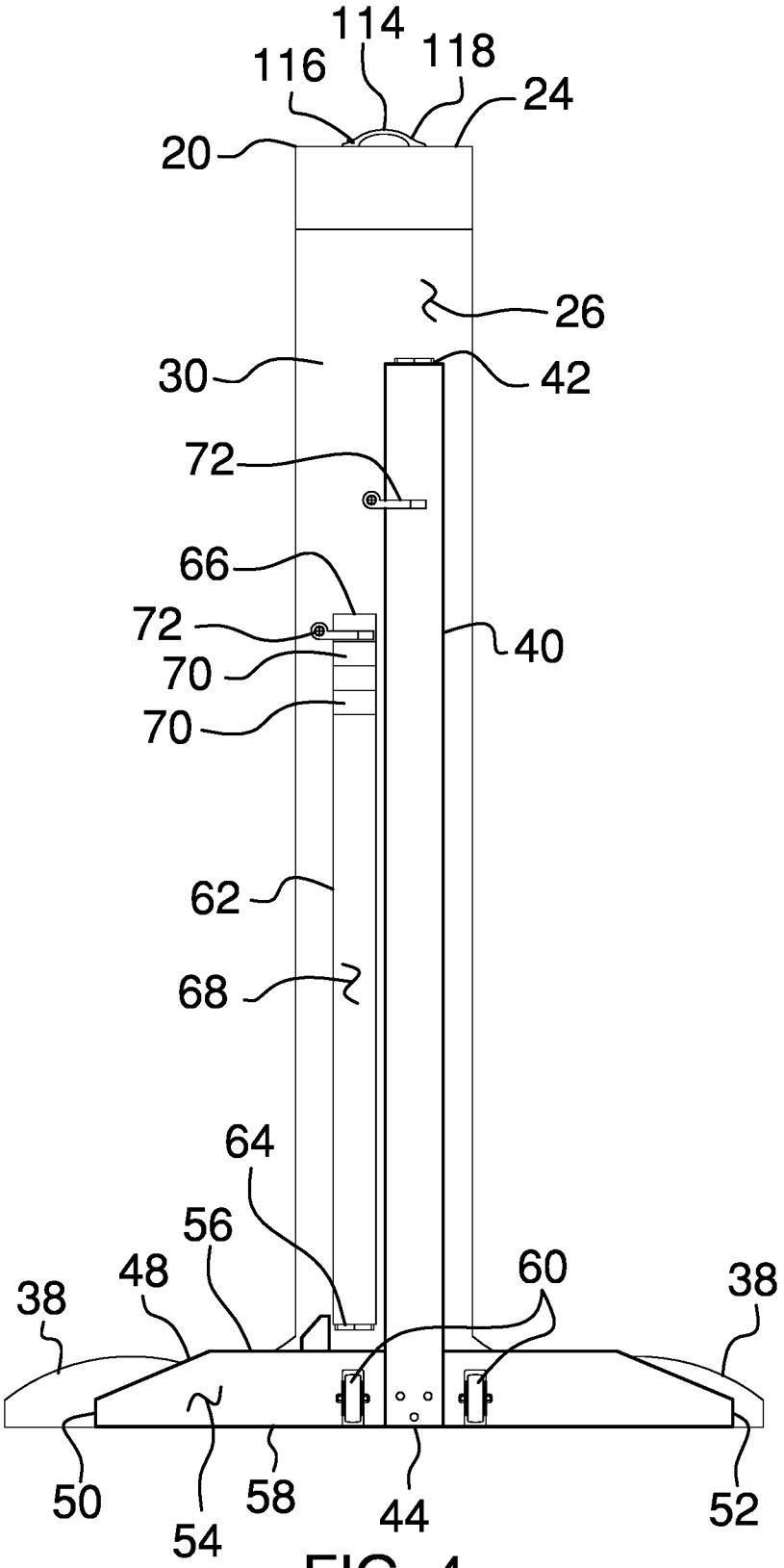
FIG. 4 is a back view of an embodiment of the disclosure.
Figure 5:
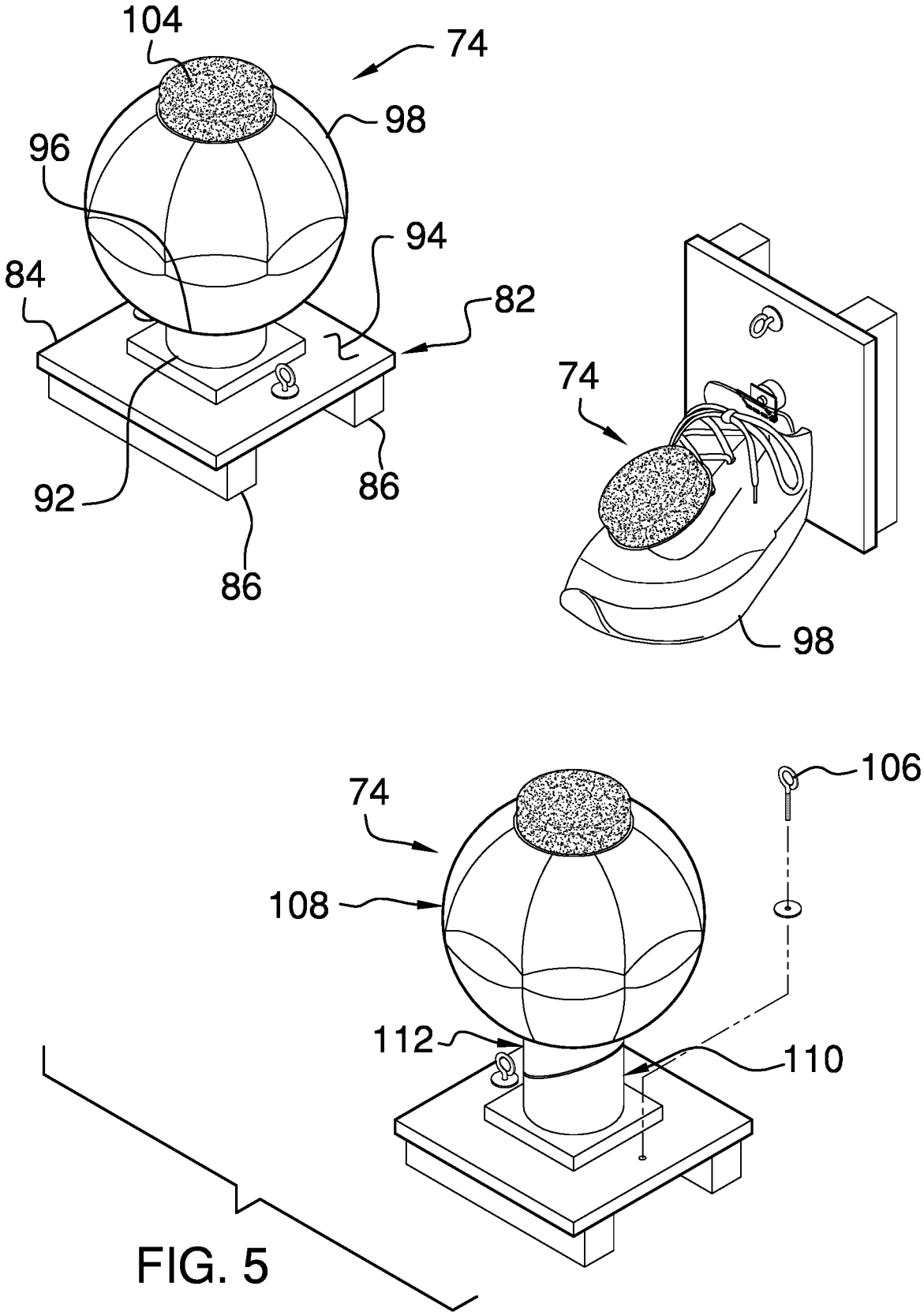
FIG. 5 is a perspective view of a plurality of targets of an embodiment of the disclosure.
Figure 6:
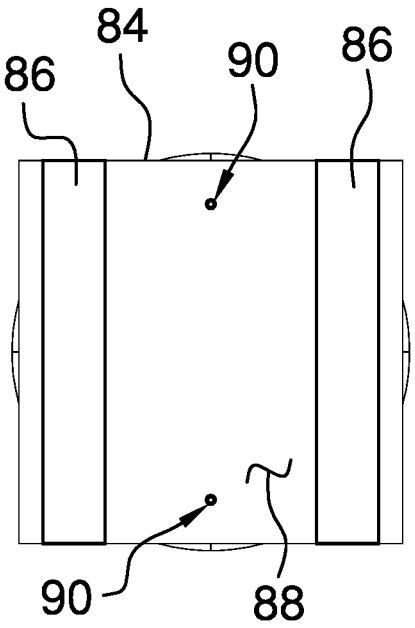
FIG. 6 is a back view of a target of an embodiment of the disclosure.

With reference now to the drawings, and in particular to FIGS. 1 through 6 thereof, a new fencing device embodying the principles and concepts of an embodiment of the disclosure and generally designated by the reference numeral 10 will be described.

As best illustrated in FIGS. 1 through 6, the fencing target assembly 10 generally comprises a stand 12 that has a plurality of hinged members 14. The stand 12 is positionable in a deployed position having each of the hinged members 14 defining a respective leg of a triangle thereby facilitating the stand 12 to be vertically oriented on a support surface 16. The support surface 16 may be a floor in a room or any other horizontal support surface. The stand 12 has a track 18 that is integrated into a respective one of the hinged members 14.

The plurality of hinged members 14 comprises a first member 20 that has a lower end 22, an upper end 24 and an outer surface 26 extending between the lower end 22 and the upper end 24, and the first member 20 is elongated between the lower end 22 and the upper end 24. The outer surface 26 has a front side 28 and a back side 30. A panel 32 is integrated into the front side 28 and the panel 32 extends between the upper end 24 and the lower end 22. Furthermore, the panel 32 is centrally positioned on the first member 20 and the panel 32 has a width is less than a width of the first member 20 such that the panel 32 defines the track 18.

The panel 32 has a distal surface 34 with respect to the front side 28 of the outer surface 26 of the first member 20 and the panel 32 has plurality of holes 36 each extending into the distal surface 34. The holes 36 are spaced apart from each other and are distributed along a full length of the panel 32. The first member 20 has a pair of feet 38 each extending laterally away from the first member 20 in opposite directions from each other. Each of the feet 38 is aligned with the lower end 22 of the first member 20 such that each of the feet 38 rests upon the support surface 16 for laterally stabilizing the first member 20 on the support surface 16.

The plurality of hinged members 14 includes a second member 40 that has a coupled end 42, a free end 44 and a front surface 46 extending between the coupled end 42 and the free end 44. The second member 40 is elongated between the coupled end 42 and the free end 44. Additionally, the coupled end 42 is hingedly coupled to the back side 30 of the outer surface 26 of the first member 20 at a point located closer to the upper end 24 of the first member 20 than the lower end 22 of the first member 20. The second member 40 is positionable in a stored position having the second member 40 lying against the back side 30 of the outer surface 26. Conversely, the second member 40 is positionable in a deployed position having the second member 40 angling away from the back side 30 of the outer surface 26.

A base 48 is included which has a primary end 50, a secondary end 52 and a primary surface 54 extending between the primary end 50 and secondary end 52, and the base 48 has a top edge 56 and a bottom edge 58. The base 48 is attached to the second member 40 having the primary surface 54 abutting the front surface 46 of the second member 40. The bottom edge 58 is aligned with the free end 44 of the second member 40 and the base 48 is perpendicularly oriented with respect to an axis extending between the coupled end 42 and the free end 44 of the second member 40. A pair of rollers 60 is each coupled to the primary surface 54 of the base 48 and each of the rollers 60 is positioned on opposite sides of the second member 40. Each of the rollers 60 rolls along the support surface 16 when the second member 40 is positioned in the deployed position and the stand 12 is tipped rearwardly to facilitate the stand 12 to be rolled along the support surface 16.

The plurality of hinged members 14 includes a third member 62 that has a coupled end 64, a free end 66 and a lower surface 68 extending between the coupled end 64 and the free end 66. The third member 62 is elongated between the coupled end 64 and the free end 66 of the third member 62. Additionally, the coupled end 64 of the third member 62 is hingedly coupled to the back side 30 of the outer surface 26 of the first member 20 at a point located closer to the lower end 22 of the first member 20 than the upper end 24 of the of the first member 20. The third member 62 is positionable in a deployed position having the third member 62 resting against the back side 30 of the outer surface 26 of the first member 20. Conversely, the third member 62 is positionable in a deployed position having the third member 62 angling away from the back side 30 of the outer surface 26.

A pair of grips 70 is each coupled to and extends away from the lower surface 68 of the third member 62. Each of the grips 70 is positioned adjacent to the free end 66 of the third member 62 and the grips 70 are spaced apart from each other. The top edge 56 of the base 48 is positioned between the grips 70 when each of the second member 40 and the third member 62 are positioned in the deployed position for retaining each of the second member 40 and the third member 62 in the deployed position. As is most clearly shown in FIG. 4, a pair of locks 72 is each rotatably coupled to the back side 30 of the outer surface 26 of the first member 20. Each of the locks 72 is positionable in a locking position having each of the locks 72 extending across a respective one of the second member 40 and the third member 62 for retaining each of the second member 40 and the third member 62 in the stored position. Conversely, each of the locks 72 is positionable in an unlocked position having each of the locks 72 being displaced from the respective second member 40 and the third member 62 thereby facilitating each of second member 40 and the third member 62 to be positioned in the deployed position.

A plurality of targets 74 is provided and each of the targets 74 is attachable to the stand 12. Furthermore, each of the targets 74 can be placed at a variety of locations on the stand 12 to facilitate a user 76 to practice fencing maneuvers. Each of the targets 74 has a penetrable element 78 to facilitate a fencing foil 80 to penetrate the penetrable element 78. Each of the targets 74 comprises a mount 82 which includes a plate 84 and a pair of blocks 86 that each coupled to a rear surface 88 of the plate 84. The blocks 86 are spaced apart from each other and the mount 82 is positionable on the front side 28 of the outer surface 26 of the first member 20 having each of the blocks 86 positioned on either side of the of the panel 32 on the front side 28 of the outer surface 26. The plate 84 has a pair of fastener holes 90 each extending through the plate 84. Furthermore, each of the fastener holes 90 is aligned with a respective one of the holes 36 in the distal surface 34 of the panel 32.

Each of the targets 74 includes a stem 92 that is coupled to and extends away from a front surface 94 of the plate 84, and the stem 92 has a distal end 96 with respect to the front surface 94 of the plate 94. Each of the targets 74 includes an ornament 98 that has a rear side 100 and a forward side 102, and the rear side 100 is coupled to the distal end 96 of the stem 92. Each of the targets 74 includes a cushion 104 that is coupled to the forward side 102 of the ornament 98 such that the cushion 104 defines the penetrable element 78 associated with the targets 74. The cushion 104 is comprised of a resiliently compressible material, including but not being limited to, rubber, silicone or other material which can be penetrated by the fencing foil 80 without damaging the fencing foil 80. The ornament 98 associated with each of the targets 74 may comprise a soccer ball, a shoe, a deflated soccer ball or any other geometric shape that could simulate the generic structure of various parts of the human body.

Each of the targets 74 includes a pair of fasteners 106 that is each extendable through a respective one of the fastener holes 90 in the plate 84. Each of the fasteners 106 releasably engages a respective one of the holes 36 in the distal surface 34 of the panel 32 to which the respective fastener hole 90 is aligned for retaining the mount 82 at a selected position along the first member 20. Each of the fasteners 106 may comprise an eyebolt, a screw or other type of releasable, mechanical fastener. The plurality of targets 74 includes a pivotable target 108, and the stem 92 associated with the pivotable target 108 includes a first section 110 that rotatably engages a second section 112. Each of the first section 110 and second section 112 engage each other on an angled plane and the first section 110 is attached to the front surface 46 of the plate 84 associated with the pivotable target 108. In this way the second section 112 can be oriented to angle away from the first section 110 at a variety of directions thereby facilitating the ornament 98 associated with the pivotable target 108 to orbit about an axis extending through the first section 110 and the plate 84 associated with the pivotable target 108.

A handle 114 is coupled to the upper end 24 of the first member 20 such that the handle 114 can be gripped for transporting the stand 12 to a desired location. The handle 114 has a first end 116 and a second end 118, and the handle 114 is curved between the first end 116 and the second end 118 of the handle 114. Each of the first end 116 and the second end 118 of the handle 114 is fastened to the upper end 24 of the first member 20 having the handle 114 curving upwardly from the upper end 24 of the first member 20. The handle 114 is gripped to tilt the stand 12 rearwardly thereby facilitating the stand 12 to be rolled on the rollers 60 for transporting the stand 12 to various locations.

In use, each of the second member 40 and the third member 62 are positioned in the deployed position such that the grips 70 on the third member 62 engage the base 48 on the second member 40. In this way the first member 20 is oriented at an angle of approximately 10.0 degrees beyond perpendicular. Each of the targets 74 is positioned at a selected point along the first member 20 and the fasteners 106 associated with each of the targets 74 is employed to retain the associated target 74 at the selected point. In this way a user 76 that is practicing fencing can strike the cushion 104 of each of the targets 74 with their fencing foil 80. Moreover, the location of the plurality of targets 74 facilitates the user 76 to simulate striking various locations of an opponent's body with their fencing foil 80. The pivotable target 108 and be oriented at an angle ranging between 0.0 degrees and 40.0 degrees, depending on the user's preference. The second member 40 and the third member 62 are positioned in the stored position and each of the locks 72 is manipulated to retain the second member 40 and the third member 62 in the stored position for storing the stand 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fencing target assembly for facilitating a fencer to practice fencing maneuvers, said assembly comprising:

a stand having a plurality of hinged members, said stand being positionable in a deployed position having each of said hinged members defining a respective leg of a triangle wherein said stand is configured to be vertically oriented on a support surface, said stand having a track being integrated into a respective one of said hinged members;

a plurality of targets, each of said targets being attachable to said stand having each of said targets being placed at a variety of locations on said stand wherein each of said targets is configured to facilitate a user to practice fencing maneuvers, each of said targets having a penetrable element wherein said penetrable element on each of said targets is configured to facilitate a fencing foil to penetrate said penetrable element;

wherein said plurality of hinged members comprises a first member having a lower end, an upper end and an outer surface extending between said lower end and said upper end, said first member being elongated between said lower end and said upper end, said outer surface having a front side and a back side;

wherein first member having a panel being integrated into said front side, said panel extending between said upper end and said lower end, said panel having a width being less than a width of said first member such that said panel defines said track, said panel having a distal surface with respect to said front, side of said outer surface of said first member, said panel having plurality of holes each extending into said distal surface, said holes being spaced apart from each other and being distributed along a full length of said panel;

wherein said first member having a pair of feet each extending laterally away from said first member in opposite directions from each other, each of said feet being aligned with said lower end of said first member wherein each of said feet is configured to rest upon a support surface for laterally stabilizing said first member on the support surface; and wherein each of said targets comprises a mount comprising a plate and a pair of blocks each being coupled to a rear surface of said plate, said blocks being spaced apart from each other, said mount being positionable on said front side of said outer surface of said first member having each of said blocks being positioned on either side of said of said panel on said front side of said outer surface, said plate having a pair of fastener holes each extending through said plate, each of said fasteners holes being aligned with a respective one of said holes in said distal surface of said panel.

2. The assembly according to claim 1, wherein said plurality of hinged members includes a second member having a coupled end, a free end and a front surface extending between said coupled end and said free end, said second member being elongated between said coupled end and said free end, said coupled end being hingedly coupled to said back side of said outer surface of said first member at a point located closer to said upper end of said first member than said lower end of said first member, said second member being positionable in a stored position having said second member lying against said back side of said outer surface, said second member being positionable in a deployed position having said second member angling away from said back side of said outer surface.

3. The assembly according to claim 2, further comprising a base having a primary end, a secondary end and a primary surface extending between said primary end and secondary end, said base having a top edge and a bottom edge, said base being attached to said second member having said primary surface abutting said front surface of said second member, said bottom edge being aligned with said free end of said second member, said base being perpendicularly oriented with respect to an axis extending between said coupled end and said free end of said second member.

4. The assembly according to claim 3, further comprising a pair of rollers, each of said rollers being coupled to said primary surface of said base, each of said rollers being positioned on opposite sides of said second member, each of said rollers rolling along the support surface when said second member is positioned in said deployed position and said stand is tipped rearwardly wherein said rollers are configured to facilitate said stand to be rolled along the support surface.

5. The assembly according to claim 1, wherein each of said targets includes a stem being coupled to and extending away from a front surface of said plate, said stem having a distal end with respect to said front surface.

6. The assembly according to claim 5, wherein each of said targets includes an ornament having a rear side and a forward side, said rear side being coupled to said distal end of said stem.

7. The assembly according to claim 6, wherein each of said targets includes a cushion being coupled to said forward side of said ornament such that said cushion defines said penetrable element associated with said targets.

8. The assembly according to claim 1, wherein each of said targets includes a pair of fasteners, each of said fasteners being extendable through a respective one of said fastener holes in said plate, each of said fasteners releasably engaging a respective one of said holes in said distal surface of said panel to which said respective fastener hole is aligned for retaining said mount at a selected position along said first member.

9. The assembly according to claim 1, further comprising a handle being coupled to said upper end of said first member wherein said handle is configured to be gripped for transporting said stand to a desired location, said handle having a first end and a second end, said handle being curved between said first end and said second end of said handle, each of said first end and said second end of said handle being fastened to said upper end of said first member having said handle curving upwardly from said upper end of said first member.

10. A fencing target assembly for facilitating a fencer to practice fencing maneuvers, said assembly comprising:

a stand having a plurality of hinged members, said stand being positionable in a deployed position having each of said hinged members defining a respective leg of a triangle wherein said stand is configured to be vertically oriented on a support surface, said stand having a track being integrated into a respective one of said hinged members; and a plurality of targets, each of said targets being attachable to said stand having each of said targets being placed at a variety of locations on said stand wherein each of said targets is configured to facilitate a user to practice fencing maneuvers, each of said targets having a penetrable element wherein said penetrable element on each of said targets is configured to facilitate a fencing foil to penetrate said penetrable element;

wherein said plurality of hinged members comprises a first member having a lower end, an upper end and an outer surface extending between said lower end and said upper end, said first member being elongated between said lower end and said upper end, said outer surface having a front side and a back side;

wherein first member having a panel being integrated into said front side, said panel extending between said upper end and said lower end, said panel having a width being less than a width of said first member such that said panel defines said track, said panel having a distal surface with respect to said front side of said outer surface of said first member, said panel having plurality of holes each extending into said distal surface, said holes being spaced apart from each other and being distributed along a full length of said panel;

wherein said first member having a pair of feet each extending laterally away from said first member in opposite directions from each other, each of said feet being aligned with said lower end of said first member wherein each of said feet is configured to rest upon a support surface for laterally stabilizing said first member on the support surface;

wherein said plurality of hinged members includes a second member having a coupled end, a free end and a front surface extending between said coupled end and said free end, said second member being elongated between said coupled end and said free end, said coupled end being hingedly coupled to said back side of said outer surface of said first member at a point located closer to said upper end of said first member than said lower end of said first member, said second member being positionable in a stored position having said second member lying against said back side of said outer surface, said second member being positionable in a deployed position having said second member angling, away from said back side of said outer surface; and wherein said plurality of hinged members includes a third member having a coupled end, a free end and a lower surface extending between said coupled end and said free end, said third member being elongated between said coupled and said free end of said third member, said coupled end of said third member being hingedly coupled to said back side of said outer surface of said first member at a point located closer to said lower end of said first member than said upper end of said of said first member, said third member being positionable in a deployed position having said third member resting against said back side of said outer surface of said first member, said third member being positionable in a deployed position having said third member angling away from said back side of said outer surface.

11. The assembly according to claim 10, further comprising a pair of grips each of said grips being coupled to and extending away from said lower surface of said third member, each of said grips being positioned adjacent to said free end of said third member, said grips being spaced apart from each other, said top edge of said base being positioned between said grips when each of said second member and said third member are positioned in said deployed position for retaining each of said second member and said third member in said deployed position.

12. The assembly according to claim 10, further comprising a pair of locks, each of said locks being rotatably coupled to said back side of said outer surface of said first member, each of said locks being positionable in a locking position having each of said locks extending across a respective one of said second member_ and said third member for retaining each of said second member and said third member in said stored position, each of said locks being positionable in an unlocked position having each of said locks being displaced from said respective second member and said third member thereby facilitating each of second member and said third member to be positioned in said deployed position.

13. A fencing target assembly for facilitating a fencer to practice fencing maneuvers, said assembly comprising:

a stand having a plurality of hinged members, said stand being positionable in a deployed position having each of said hinged members defining a respective leg of a triangle wherein said stand is configured to be vertically oriented on a support surface, said stand having a track being integrated into a respective one of said hinged members, said plurality of hinged members comprising:

a first member having a lower end, an upper end and an outer surface extending between said lower end and said upper end, said first member being elongated between said lower end and said upper end, said outer surface having a front side and a back side, first, member having a panel being integrated into said front side, said panel extending between said upper end and said lower end, said panel having a width being less than a width of said first member such that said panel defines said track, said panel having a distal surface with respect to said front side of said outer surface of said first member, said panel having plurality of holes each extending into said distal surface, said holes being spaced apart from each other and being distributed along a full length of said panel, said first member having a pair of feet each extending laterally away from said first member in opposite directions from each other, each of said feet being aligned with said lower end of said first member wherein each of said feet is configured to rest upon a support surface for laterally stabilizing said first member on the support surface;

a second member having a coupled end, a free end and a front surface extending between said coupled end and said free end, said second member being elongated between said coupled end and said free end, said coupled end being hingedly coupled to said back side of said outer surface of said first member at a point located closer to said upper end of said first member than said lower end of said first member, said second member being positionable in a stored position having said second member lying against said back side of said outer surface, said second member being positionable in a deployed position having said second member angling away from said back side of said outer surface;

a base having a primary end, a secondary end and a primary surface extending between said primary end and secondary end, said base having a top edge and a bottom edge, said base being attached to said second member having said primary surface abutting said front surface of said second member, said bottom edge being aligned with said free end of said second member, said base being perpendicularly oriented with respect to an axis extending between said coupled end and said free end of said second member;

a pair of rollers, each of said rollers being coupled to said primary surface of said base, each of said rollers being positioned on opposite sides of said second member, each of said rollers rolling along the support surface when said second member is positioned in said deployed position and said stand is tipped rearwardly wherein said rollers are configured to facilitate said stand to be rolled along the support surface;

a third member having a coupled end, a free end and a lower surface extending between said coupled end and said free end, said third member being elongated between said coupled and said free end of said third member, said coupled end of said third member being hingedly coupled to said back side of said outer surface of said first member at a point located closer to said lower end of said first member than said upper end of said of said first member, said third member being positionable in a deployed position having said third member resting against said back side of said outer surface of said first member, said third member being positionable in a deployed position having said third member angling away from said back side of said outer surface; and a pair of grips each of said grips being coupled to and extending away from said lower surface of said third member, each of said grips being positioned adjacent to said free end of said third member, said grips being spaced apart from each other, said top edge of said base being positioned between said grips when each of said second member and said third member are positioned in said deployed position for retaining each of said second member and said third member in said deployed position;

a pair of locks, each of said locks being rotatably coupled to said back side of said outer surface of said first member, each of said locks being positionable in a locking position having each of said locks extending across a respective one of said second member and said third member for retaining each of said second member and said third member in said stored position, each of said locks being positionable in an unlocked position having each of said locks being displaced from said respective second member and said third member thereby facilitating each of second member and said third member to be positioned in said deployed position; and a plurality of targets, each of said targets being attachable to said stand having each of said targets being placed at a variety of locations on said stand wherein each of said targets is configured to facilitate a user to practice fencing maneuvers, each of said targets having a penetrable element wherein said penetrable element, on each of said targets is configured to facilitate a fencing foil to penetrate said penetrable element, each of said targets comprising:

a mount comprising a plate and a pair of blocks each being coupled to a rear surface of said plate, said blocks being spaced apart from each other, said mount being positionable on said front side of said outer surface of said first member having each of said blocks being positioned on either side of said of said panel on said front side of said outer surface, said plate having a pair of fastener holes each extending through said plate, each of said fasteners holes being aligned with a respective one of said holes in said distal surface of said panel;

a stem being coupled to and extending away from a front surface of said plate, said stem having a distal end with respect to said front surface;

an ornament having a rear side and a forward side, said rear side being coupled to said distal end of said stem;

a cushion being coupled to said forward side of said ornament such that said cushion defines said penetrable element associated with said targets; and a pair of fasteners, each of said fasteners being extendable through a respective one of said fastener holes in said plate, each of said fasteners releasably engaging a respective one of said holes in said distal surface of said panel to which said respective fastener hole is aligned for retaining said mount at a selected position along said first member; and a handle being coupled to said upper end of said first member wherein said handle is configured to be gripped for transporting said stand to a desired location, said handle having a first end and a second end, said handle being curved between said first end and said second end of said handle, each of said first end and said second end of said handle being fastened to said upper end of said first member having said handle curving upwardly from said upper end of said first member.

* * * * *